United States Patent [19]

Pentzien

[11] 4,119,343

[45] Oct. 10, 1978

[54] PLATFORM ROCKER STRUCTURE

[75] Inventor: Fred R. Pentzien, Naperville, Ill.

[73] Assignee: Kroehler Mfg. Co., Naperville, Ill.

[21] Appl. No.: 828,477

[22] Filed: Aug. 29, 1977

Related U.S. Application Data

[63] Continuation-in-part of Ser. No. 759,912, Jan. 17, 1977, abandoned.

[51] Int. Cl.[2] ..... A47C 3/02

[52] U.S. Cl. ..... 297/264; 267/149; 248/387; 297/268

[58] Field of Search ..... 297/264, 215, 268, 293; 248/387; 267/133, 149

[56] References Cited

U.S. PATENT DOCUMENTS

| | | | |
|---|---|---|---|
| 163,287 | 5/1875 | Wheeler et al. | 248/387 |
| 821,055 | 5/1906 | Ordway | 248/387 |
| 1,231,148 | 6/1917 | Gabrielse | 297/293 |
| 2,586,951 | 2/1952 | Johnson | 297/302 X |
| 2,664,146 | 12/1953 | Jackson | 248/387 |
| 2,828,801 | 4/1958 | Papst | 267/133 X |
| 3,465,997 | 9/1969 | Piske | 248/387 X |
| 3,682,466 | 8/1972 | Huchette et al. | 267/149 X |

FOREIGN PATENT DOCUMENTS

| | | | |
|---|---|---|---|
| 477,536 | 10/1951 | Canada | 248/387 |

*Primary Examiner*—Roy D. Frazier
*Assistant Examiner*—Peter A. Aschenbrenner
*Attorney, Agent, or Firm*—Arnstein, Gluck, Weitzenfeld & Minow

[57] ABSTRACT

A platform rocker structure for supporting a chair seat and back for rocking motion includes two or more flexure members formed of epoxy-glass laminates which have unusual flexural characteristics and high resistance to flexural fatigue.

3 Claims, 6 Drawing Figures

FIG.3
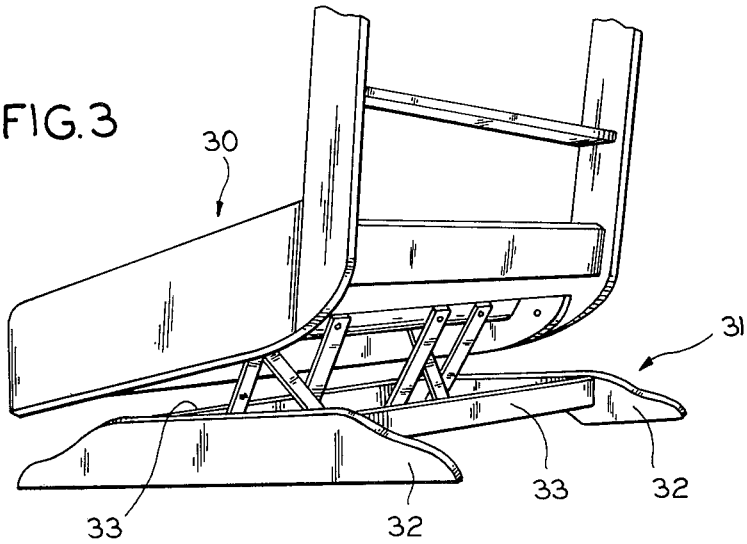
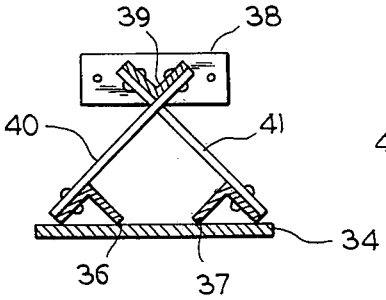
FIG.5
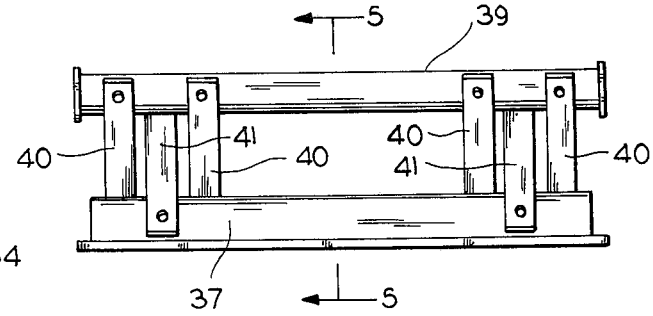
FIG.4
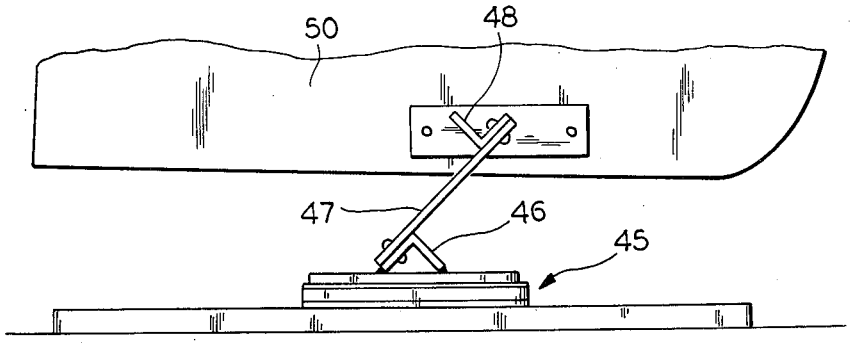
FIG.6

PLATFORM ROCKER STRUCTURE

This is a continuation-in-part of my co-pending application Ser. No. 759,912, filed Jan. 17, 1977, now abandoned.

BACKGROUND OF THE INVENTION

This invention relates to a platform rocker structure and more particularly to a flexure support means for the chair seat of the rocker.

Various forms of chair seat supporting structures have been employed in platform rockers to permit rocking of the chair seat while resiliently biasing the chair seat toward a rest position on the base. Heretofore, coiled compression springs or leaf springs have been used in combination with other supporting arrangements for the chair seat. Such arrangements generally, include a number of parts which are large and cumbersome adding substantial weight to the rocker construction, as well as increasing the cost of manufacture.

Among the objects of my invention is the provision in a platform rocker of chair seat supporting means which is extremely simple and light weight in construction, which will permit rocking of the chair seat and which has a high resistance to flexure fatigue, insuring a long service life.

Other and further objects of this invention will become apparent from the following description when considered in connection with the accompanying drawings.

BRIEF DESCRIPTION OF THE DRAWINGS

FIG. 3 is a rear perspective view of a platform rocker embodying a modified form of my invention.

FIG. 4 is a fragmentary front elevational view of the modified embodiment illustrated in FIG. 3, with certain parts eliminated.

FIG. 5 is a cross-sectional view taken substantially on line 5—5 of FIG. 4, and FIG. 6 is a fragmentary end elevational view of another modified embodiment.

BRIEF DESCRIPTION OF THE PREFERRED EMBODIMENTS

Figure 1:
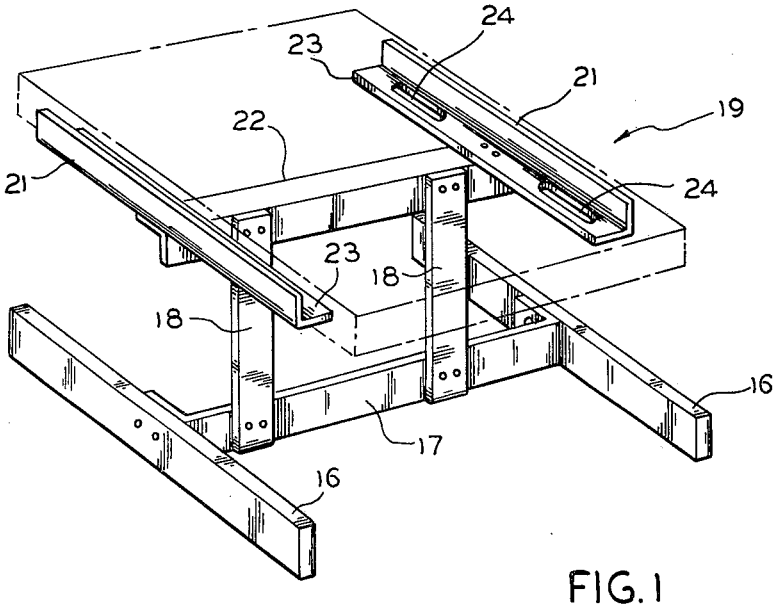
FIG. 1, is a perspective view of a chair seat support structure, in accordance with the present invention, with the chair seat removed.
Figure 2:
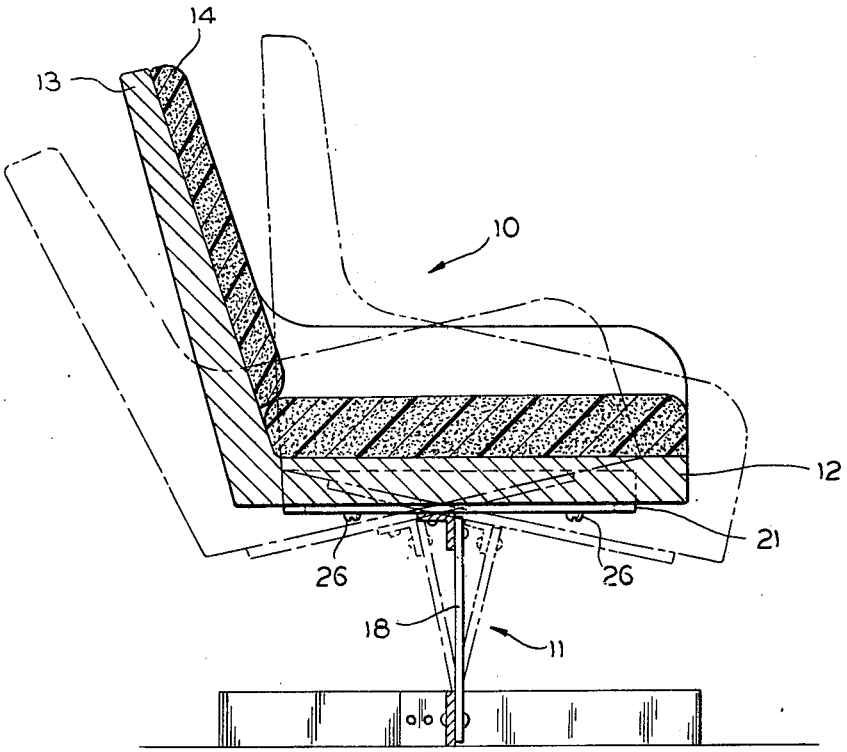
FIG. 2 is a longitudinal vertical cross-section through the platform rocker, with the chair seat mounted on the supporting structure.

Referring to the drawings, the embodiment illustrated in FIG. 2, comprises a chair seat 10 supported on a rocker structure 11 having a floor engaging base. The chair seat is rockable, as indicated by the broken lines in FIG. 2.

The chair seat 10 may comprise a frame including a horizontal seat member 12 and a back member 13 covered by suitable cushioning material 14. It will be understood that the style of furniture shown is merely exemplary and that my invention is not limited to the particular style shown but is applicable to rocker reclining chairs, platform rockers, swivel rockers and office desk chairs.

The base may comprise a pair of spaced parallel members 16 connected by a transverse member 17 having angular terminal portions suitably secured to the member 16 and forming a generally H-shaped structure.

Secured to the transverse member 17 are a pair of upright spaced flexure members 18, 18 which support a generally H-shaped frame 19 comprising a pair of spaced angle members 21, 21 secured intermediate thereof to a transverse angle member 22. Each of the horizontal leg portions 23 of the members 21 is provided with spaced elongated slots 24, 24. The members 21 are arranged to receive and support therebetween the seat frame portion 12 of a chair seat 10 which is adjustably secured to the members 21 by suitable fastening means 26 which pass through the elongated slots 24. Thus, the seat 12 is adjustable on the members 21 within the limits of the slots 24, for balancing purposes.

The members 18, 18 preferably comprise rectangular sections of Scotchply reinforced plastic, Type 1002 manufactured by 3M Company. This material is a moldable epoxy glass laminate having an epoxy resin content 36% by weight, and glass filament orientation which may be unidirectional, cross plied or isotropic, as desired.

In an experimental unit two members 18, each having the following dimensions, length 9 inches, width 1.5 inches and thickness 0.25 inches were mounted in a frame structure as illustrated and subjected to continuous flexure fatigue stresses. After one million cycles no deterioration in the members 18 was observed.

Referring to the modified embodiment illustrated in FIG. 3, the chair seat 30 is supported on a base structure 31 which includes a pair of floor engaging parallel members 32, 32 connected by a pair of transverse members 33, 33. A panel 34 is secured to the members 33 and suitably supported thereon are a pair of parallel angle members 36, 37 in spaced relation and arranged as illustrated in FIG. 5 with their apexes directed upwardly.

Secured to plate members 38 fixed to the seat frame members on the underside of the seat and substantially medially of the members 36, 36 is a similar angle member 39 with its apex directed downwardly. A plurality of flexure members 40 and 41, similar to the flexure members 18 are secured to the angle members 36, 37 and 39, in the manner illustrated in FIGS. 4 and 5. A pair of spaced flexure members 40 is secured, each at its lower end, to each end portion of member 36. The members 40 extend angularly and are secured at their upper ends to member 39. Flexure members 41 are secured, each at a lower end, to member 37 intermediate each pair of flexure members 40 and each flexure member 41 is secured at its upper end to member 39. The flexure members 40 and 41 intersect each other, as shown.

In the embodiment illustrated in FIG. 6 there is shown a conventional swivel base 45 rested on a floor surface. Suitably secured to and supported on the base 45 is an angle iron 46 arranged with its apex uppermost. A flexure member 47 is secured at its lower end to one leg of the angle iron 46, and the upper end of said flexure member is secured to one leg of an angle iron 48, the latter being secured to plate members 49 fixed to the sidemembers of the chair frame 50.

While right angle members such as 48 and 49 are illustrated, it will be understood that my invention contemplates the use of a block type support means having an attaching surface of any suitable angle so that the flexure members may extend angularly along any line intermediate 0° and 90°. Thus, by varying the angle of inclination of the flexure members adjustment of seat height may be effected.

It will, of course, be understood that the dimensions of the flexure members are determined by the load intended to be carried and the degree of flexibility desired.

Either of the embodiments, above described, may be employed with a fixed or swivel ground engaging base structure.

Various changes coming within the spirit of my invention may suggest themselves to those skilled in the art; hence, I do not wish to be limited to the specific embodiments shown and described or uses mentioned, but intend the same to be merely exemplary the scope of invention being limited only by the appended claims.

I claim:

1. A platform type rocking seat, comprising (a) a floor engaging base for supporting a seat, (b) an angled structural member mounted on said base in a direction transverse to the central vertical plane through the front and rear of said seat, said member having two intersecting surfaces forming an upwardly directed apex, (c) a second angled structural member mounted across the underside of said seat above, rearwardly, and in parallel to said first-mentioned member, said second member also having two intersecting surfaces forming a downwardly directed apex, with the rearward surface of the latter disposed in a plane parallel to the forward surface of said first member and displaced forwardly therefrom a slight distance, (d) straight coplanar flexure members of epoxy glass laminate material of a thickness corresponding to said distance extending between said rearward surface of the second structural member and the forward surface of said first member, and (e) means for affixing the opposite ends of said flexure members to the said rearward and forward surfaces of said respective structural members.

2. The invention as defined in claim 1, in which the angled structural members are of identical cross-section to adapt the mounting of lengths of a single structural member on both the base and seat.

3. The invention set forth in claim 2, wherein said straight coplanar flexure members are each constituted of said laminate material of a thickness of the order of 0.25 inches, with each having the opposite ends thereof fastened to said angled structural member adajcent to the opposite ends of the latter.

* * * * *

Notice of Adverse Decision in Interference

In Interference No. 100,609, involving Patent No. 4,119,343, F. R. Pentzien, PLATFORM ROCKER STRUCTURE, final judgment adverse to the patentee was rendered Aug. 31, 1981, as to claims 1, 2, and 3.

[*Official Gazette November 3, 1981.*]